United States Patent [19]

Veillas

[11] Patent Number: 4,713,010

[45] Date of Patent: Dec. 15, 1987

[54] APPARATUS FOR SIMULATING THE DIFFERENT PACES OF A HORSE AND THE AIDS TO BE APPLIED FOR CONTROLLING THE HORSE

[76] Inventor: Paul Veillas, Domaine de Saint-Aubin, Saint-Aubin, F-91190 Gif-sur-Yvette, France

[21] Appl. No.: 881,299

[22] Filed: Jul. 2, 1986

[30] Foreign Application Priority Data

Jul. 4, 1985 [FR] France ..... 85 10198

[51] Int. Cl.[4] ..... G09B 9/00

[52] U.S. Cl. ..... 434/247

[58] Field of Search ..... 434/247

[56] References Cited

U.S. PATENT DOCUMENTS

| | | | |
|---|---|---|---|
| 3,657,456 | 4/1972 | Kozak . | |
| 4,086,710 | 5/1978 | Craine . | |
| 4,457,715 | 7/1984 | Knight et al. | 434/247 |
| 4,592,730 | 6/1986 | Knight et al. | 434/247 |

*Primary Examiner*—Leo P. Picard

*Attorney, Agent, or Firm*—Pollock, VandeSande & Priddy

[57] ABSTRACT

In an apparatus for simulating the different paces of a horse and the aids to be applied for controlling the horse, four representative display lamps light-up in order to represent the precise time-duration of the instant of ground contact of the different hooves of a horse and are supplied by four separate circuits in dependence on control devices for ensuring different lighting-up recurrence rates and sequences with a view to reproducing different types of paces of a horse. In addition, a signal lamp is intended to light-up so as to represent predetermined aids for controlling a horse, this lamp being connected into a circuit which includes an operating key at the user's disposal. Closing of the circuit at a predetermined instant has the effect of turning-on the lamp and blocking the circuits of the representative display lamps in their state of operation at that instant.

10 Claims, 7 Drawing Figures

APPARATUS FOR SIMULATING THE DIFFERENT PACES OF A HORSE AND THE AIDS TO BE APPLIED FOR CONTROLLING THE HORSE

BACKGROUND OF THE INVENTION

The present invention relates to an apparatus for simulating the different paces of a horse and the aids to be applied for the purpose of controlling the horse.

This apparatus is intended to enable horse-riders and non-riders alike to analyze themselves and to become familiar with the different paces or gaits of a horse in order to make profitable use of the new horse-riding method known as the "balance method". This method is based on a knowledge of the mechanisms of locomotion as well as the innate reflexes of the horse, these reflexes being put to profitable use for applying "aids" or in other words assisting the horse, thus more readily developing the conditional reflexes required by the rider for teaching the horse to take up different postures, carry out changes of direction, and perform movements which are not natural or innate. With this objective, the rider must know the exact periods of time during which the horse's forefeet and hindfeet are each in contact with the ground in order that the rider's own weight applied through the saddle and stirrups may be intentionally utilized at any given moment as a function of the ground contact pressures which the rider desires either to increase or reduce. This is what is improperly referred-to in current jargon as "weight aids" although it is actually a matter of utilizing all or part of the rider's weight applied through his or her internal forces in order to produce a controlling action on the horse.

In order to apply this method in a suitable manner, riders should therefore be wholly acquainted with the sequence of ground contacts of the horse's hooves and of uplifts of each hoof according to its different paces or gaits. It is essential, however, for riders to understand the sequence of movements of the horse and the transitions between its different paces. Moreover, riders must necessarily train in order to apply a predetermined aid at the exact moment when this aid is effective. This presents an awkward problem by reason of the different reaction times of each individual rider and of each horse. In fact, reaction times are liable to vary in duration from a few hundredths to a few tenths of a second.

For the reason just given, the apparatus in accordance with the invention is so designed as to enable riders and non-riders alike to begin by making themselves familiar with the various movements of a horse and to follow a course of indoor training in order to carry out predetermined control actions by simulating the performance of such control actions or so-called "aids" during the movements of the horse.

SUMMARY OF THE INVENTION

With the foregoing objects in view, the apparatus in accordance with the invention includes a display panel provided with:

on the one hand four representative display lamps or the like which are intended to light-up so as to represent the precise time-duration of the instant of ground contact of the different hooves of a horse and are supplied by four separate circuits in dependence on one or a number of control devices which are capable of ensuring different lighting-up recurrence rates and sequences so as to reproduce different types of paces of a horse (walk, trot, canter, gallop, etc.);

on the other hand a signal lamp which is intended to light-up so as to represent predetermined aids for controlling a horse, said signal lamp being connected into a circuit which includes an operating key at the user's disposal and the arrangement of which is such that closing of said circuit has the effect both of turning-on the signal lamp and blocking the circuits of the representative display lamps in their state of operation at that instant.

Thus the person who is using the apparatus in accordance with the invention can immediately determine whether his or her control action has been carried out at the exact moment required or, on the contrary, too soon, or else again too late. It is then possible for the user to repeat this training exercise until a user finally succeeds in acting at the right moment. Furthermore, apart from this possibility of training, the present apparatus can also serve to analyze the different types of paces of a horse and to enable the user to become wholly familiar with the sequence of hoof-landing positions in each case considered.

Preferably, a second representative display lamp is provided next to each lamp representing the time of ground contact of one of the horse's hooves. Lighting-up of this second lamp is intended to represent the exact time of uplift of the same hoof, that is to say the time interval which elapses between leaving the ground and landing. The second set of lamps thus provided is supplied by circuits which are controlled in dependence on the same control devices as the lamps representing the hoof-landing or ground contact periods in order to reproduce different types of paces of a horse in combination with said ground contact periods.

In an advantageous embodiment of the apparatus under consideration, the display panel provides a representation of the silhouette of a horse and its rider and outlines representing the four hooves of the horse. Provision is made in the location defined by each hoof-outline for a pair of lamps having the function in one case of displaying the instant of ground contact of a hoof and in the other case of displaying the instant of uplift of the corresponding hoof. Instead of a single signal lamp, provision is made for a series of signal lamps which have the intended function in each case of representing a predetermined aid applied by a rider and which are placed on or against the horse's silhouette in positions corresponding to the particular nature of these aids. Each signal lamp is connected into a circuit provided with a control key at the user's disposal and so arranged that closing of said circuit at a predetermined moment has the effect both of turning-on said lamp and blocking the circuits of the representative display lamps in the state of said circuits at that moment.

BRIEF DESCRIPTION OF THE DRAWINGS

These and other features of the invention will be more apparent upon consideration of the following description and accompanying drawings, wherein.

DESCRIPTION OF THE PREFERRED EMBODIMENTS

Figure 1:
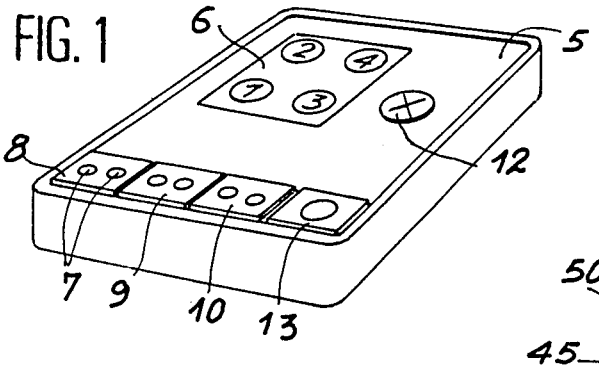
FIG. 1 is a perspective view showing a first embodiment of the apparatus in accordance with the invention.

In the example illustrated in FIG. 1, the apparatus in accordance with the invention is constituted by a casing 5, the top face of which forms a display panel. This panel is provided with four representative display lamps 1, 2, 3, 4 so arranged as to represent the contacts of the four hooves of a horse with the ground. The lamps 1 and 3 correspond respectively to the left rear hoof and to the right rear hoof whilst the lamps 2 and 4 correspond respectively to the left front hoof and to the right front hoof. These lamps can consist of luminescent diodes appearing behind a transparent or translucent screen 6 which occupies part of the top face of the casing 5 or is placed at right angles to this latter.

These lamps are supplied by four separate and distinct electric circuits which can be made dependent on different control devices for subjecting them to different lighting-up recurrence rates and sequences in order to reproduce different types of gaits or paces of a horse such as in particular the walk, the trot and the canter or gallop. At least three separate and distinct control devices corresponding to these three paces are therefore provided. For each type of pace, however, provision can be made for several distinct control devices corresponding to alternative paces or different speeds. The control devices thus provided may be equipped with timing contactors which may or may not be adjustable.

The top face of the casing 5 is adapted to carry on one of its edges a series of operating elements which make it possible to switch-over the control devices or to change the computer programs for controlling the operation of the representative display lamps 1, 2, 3, 4. Said operating elements can consist of keys 7 distributed in three blocks 8, 9 and 10 corresponding respectively to the walk, the trot and the gallop. Each of these blocks may accordingly have either a single key or on the contrary a number of keys in order to display alternative forms of any one pace.

In addition to the four representative display lamps which have already been mentioned and are always placed at the corners of a rectangle, the top face of the casing 5 is adapted to carry a fifth lamp 12 which constitutes a signal lamp. Lighting-up of this lamp is intended to indicate a predetermined aid applied to a horse. This fifth lamp is supplied by a separate circuit having a contactor actuated by a key 13.

However, the circuit of said fifth signal lamp 12 is connected to the circuit of the representative display lamps 1, 2, 3, 4 and the arrangement is such that closing of the circuit of the signal lamp 12 has the effect of blocking the circuits of the representative display lamps in their state of operation at the moment when the user of the apparatus depresses the key 13 which controls the lamp 12.

As has already been mentioned, the apparatus in accordance with the invention enables a beginner in equitation to analyze the different paces of a horse and to gain familiarity with the ground-contact or landing sequence of a horse's hooves.

Accordingly, the sequence of movements and transitions between the paces can be readily understood by the student. From the knowledge thus acquired, the student can accordingly learn to apply aids at the correct moment in the system of balance of the horse in order to turn it to profitable account. The basic concept of the appliance under consideration lies in the possibility of learning to apply an aid at the right moment and of checking the result each time.

Figure 2:
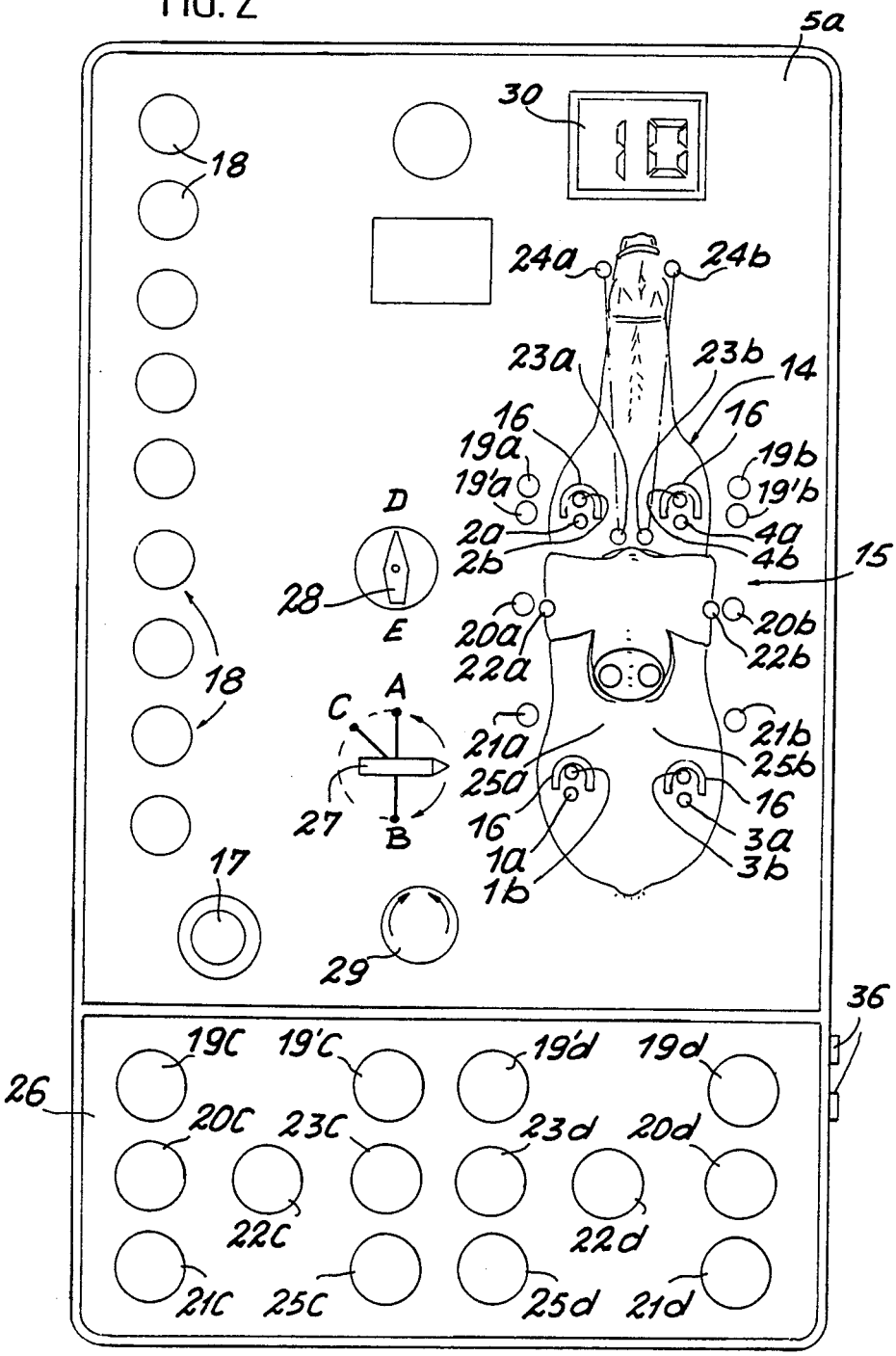
FIG. 2 is an overhead plan view to a different scale showing another embodiment of the apparatus.

FIG. 2 illustrates another embodiment of the apparatus in accordance with the invention. In this form of construction, the display panel 5*a* of said apparatus provides a pictorial representation 14 of the silhouette of a horse seen in an overhead plan view as well as a representation 15 of the rider's saddle. However, within the silhouette are also shown horseshoe outlines 16 which represent the corresponding locations of the horse's four hooves.

As in the previous embodiment, this display panel includes four representative display lamps having the function of representing the times of ground contacts of the horse's four hooves. In the present case, these representative display lamps 1*a*, 2*a*, 3*a* and 4*a* are placed within the outline 16 of the different corresponding hooves. However, provision is made next to each of these representative display lamps for another representative display lamp 1*b*, 2*b*, 3*b* or 4*b* which is intended to represent the exact time of uplift of the corresponding hoof. These two series of representative display lamps are of different colors such as red, for example, in the case of the ground-contact lamps and green in the case of the hoof-uplift lamps.

These various lamps are connected into supply circuits controlled in dependence on control devices which are capable of imparting different lighting-up recurrence rates and sequences in order to reproduce different types of paces of a horse. A changeover from one type of pace to another can be produced by applying successive pressures on a general control key 17, a series of signal lights 18 being provided for indicating the type of pace initiated on the apparatus.

Instead of a single signal lamp 12 which alone has the function of indicating different types of predetermined control actions or aids applied to a horse, provision is made for a plurality of signal lamps each having the function of illustrating a specific aid. Moreover, these different signal lamps are placed on or against the silhouettes 14 and 15 of the horse and of its rider in precise positions corresponding to the type of each aid to be illustrated.

Thus three signal lamps 19*a*, 20*a*, 21*a* or 19*b*, 20*b*, 21*b* are placed opposite to each flank of the horse-silhouette 14 and are intended to illustrate three different types of actions produced by the rider on the stirrup located on the corresponding side whilst the two signal lamps 19*a*, 19*b* indicate a forward counterbalance action, the two signal lamps 20*a* and 20*b* indicate a vertical pressure in the transverse plane which passes through the center of gravity of the horse and the two signal lamps 21*a* and 21*b* indicate a rearward action. Moreover, the lamps 19'*a* and 19'*b* have the function of indicating a weight-addition action to the right or to the left when the horse sets its left hoof or right hoof on the ground.

Provision is made on both flanks of the horse-silhouette for another signal lamp 22*a* or 22*b* which has the function of representing a pressure applied either by the rider's left leg or by the rider's right leg on the corresponding flank.

Two other signal lamps 23*a* and 23*b* placed in the two locations corresponding to the rider's hands have the function of representing the control action of the hands on the reins. In addition, two other signal lamps 24*a* and 24*b* have the function of illustrating the effect produced by these control actions on the horse's mouth and posture.

Yet another pair of signal lamps 25*a* and 25*b* placed at the assumed location of the rider's buttocks on the saddle have the function of indicating a thrust produced by the weight of the upper part of the rider's body and exerted on the horse's back by either or both of the rider's buttocks.

These various signal lamps are different in color from the lamps representing the ground contacts and uplifts of the horse's hooves. The aforementioned signal lamps may thus be yellow with the exception of the lamps 22*a* and 22*b* which are of yet another color such as blue, for example.

However, provision could be made for even more signal lamps having the function of indicating other predetermined types of aids applied by the rider.

The different signal lamps are connected into separate supply circuits each provided with an individual control push-button designated respectively by the references 19*c*, 19'*c*, 20*c*, 21*c*, 22*c*, 23*c* and 25*c* for the signal lamps 19*a*, 19'*a*, 20*a*, 21*a*, 22*a*, 23*a* and 25*a*, and with an individual control push-button 19*d*, 19'*d*, 20*d*, 21*d*, 22*d*, 23*d* and 25*d* for the signal lamps 19*b*, 19'*b*, 20*b*, 21*b*, 22*b*, 23*b* and 25*b*. These push-buttons are placed on a control keyboard 26 placed next to the display panel 5*a* on the external face of a casing containing the different control circuits as well as the other elements and components of the apparatus. However, the circuits for controlling the signal lamps are also connected to the circuits of the signal lamps representing ground contacts and uplifts of the horse's hooves in order to carry out blocking of the circuits of these various lamps in the state of operation of these circuits at the time of depression of any one of the control push-buttons of the keyboard 26.

As in the previous embodiment, the user of the apparatus is thus in a position to judge whether the aid applied by him and materialized by depression of one of the push-buttons of the keyboard 26 has been effected at the right moment or not. However, the connection of these two series of circuits is provided by means of a changeover switch controlled by operation of a rotatable pointer strip 27 having three positions A, B, C which correspond to the following three types of operation:

In position A, the connection of the different circuits is such that depression of one or a number of push-buttons of the keyboard 25 has the simultaneous effect of initiating turn-on of the corresponding signal lamps and blocking of the signal lamps representing ground contacts and uplifts of the horse's hooves in their state of operation at this moment.

In position B, the connection of the circuits is such that operation of one or a number of push-buttons of the keyboard 26 has the effect not only of turning-on the corresponding signal lamps but also of changing the horse's pace which had previously been programmed by operation of the general control push-button 17. This change in pace is accordingly a function of the nature of the aid or aids applied by the rider as materialized by depression of one or a number of push-buttons of the keyboard 26.

In position C, connection of the different circuits is such that, at the time of operation of one or a number of push-buttons of the keyboard 26, the desired change in pace is obtained immediately after blocking of the different signal lamps representing ground contacts and uplifts of the horse's hooves, thus making it possible to obtain a representation of the corresponding transition.

By placing the changeover switch in position B, it is thus possible to check during performance of a representation of the horse's motion whether synchronization is being maintained. As the operator will therefore be able to observe, the change in pace of the horse is apparent from the modification in rhythm of the succession of ground contacts and uplifts of the hooves. These changes in pace are governed by application of the principles of the method of equitation known as the "balance method". The programs of control of the recurrence rate (rhythm) and of the sequence of lighting-up of the signal lamps representing ground contacts and uplifts of the hooves are therefore designed to be modified in consequence by corresponding aids which are in turn materialized by actuation of one or a number of the push-buttons of the control keyboard 26.

In order to enable the beginner to acquire familiarity with the apparatus, a system is preferably provided for slowing-down the normal pace chosen on the push-button 17. To this end, provision is made for a second changeover switch actuated by means of a rotatable control knob 28. In a first control-knob position D, the control circuits are locked on performance of the pace chosen for slow motion at a very low speed which permits extended study of each pace. In the second position E, said changeover switch makes it possible to control the performance of the selected pace in dependence on a potentiometer provided with a rotary control knob 29. The performance rate of the selected pace may accordingly be chosen at will. The display panel 5*a* can also be provided with the visual indicator 30 of a counter for checking the time-duration of the different stages of the selected pace within a cycle having divisions of 100.

Figure 3:
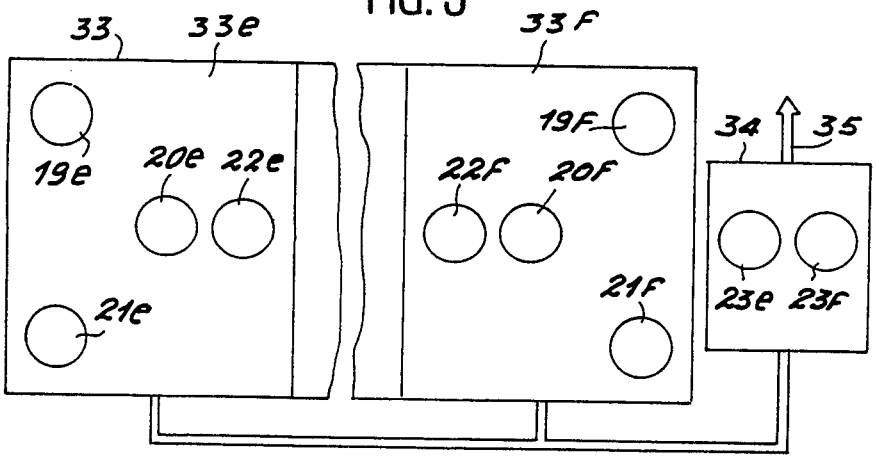
FIG. 3 is an overhead plan view of two control units designed for use with the apparatus shown in FIG. 2.

FIG. 3 illustrates two control units which are designated respectively by the references 33 and 34 and can be employed with the apparatus illustrated in FIG. 2. These units may accordingly be connected to the apparatus by means of a cable link 35 connected to a plug 36 carried by the casing of the apparatus. The control keyboard 26 can accordingly be permitted to remain while being virtually short-circuited when the control units 33 and 34 are employed. However, in another embodiment of the apparatus, this keyboard can be completely dispensed with.

The control unit 33 is intended to be placed on the ground so that the control push-buttons provided on the two separate portions 33*e* and 33*f* of said unit can be actuated by the operator with either one foot or the other. The push-buttons 19*e*, 20*e*, 21*e* and 22*e* provided on the portion 33*e* as well as the push-buttons 19*f*, 20*f*, 21*f* and 22*f* provided on the portion 33*f* control the signal lamps which indicate the actions of the riders performed with either one leg or the other.

In regard to the control unit 34, this unit is intended to be placed next to the display panel 5*a* in order to be controlled with either hand. The unit is provided for this purpose with two push-buttons 23*e* and 23*f* which control the operation of signal lamps indicating the aids applied by the hands and reins on the horse's mouth at 24*a* and 24*b*.

The use of the control units shown in FIG. 3 enables the operator to come close to the practical conditions of horse-riding since he or she has to apply fictitious aids with either foot and either hand.

Figure 5:
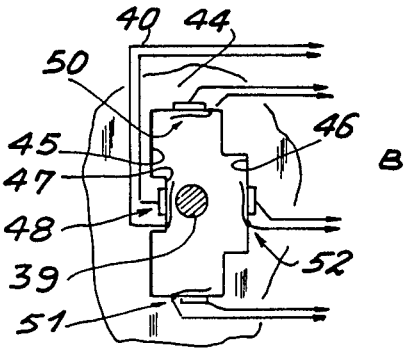
FIG. 5 is a fragmentary sectional view taken along line V—V of FIG. 4.
Figure 4:
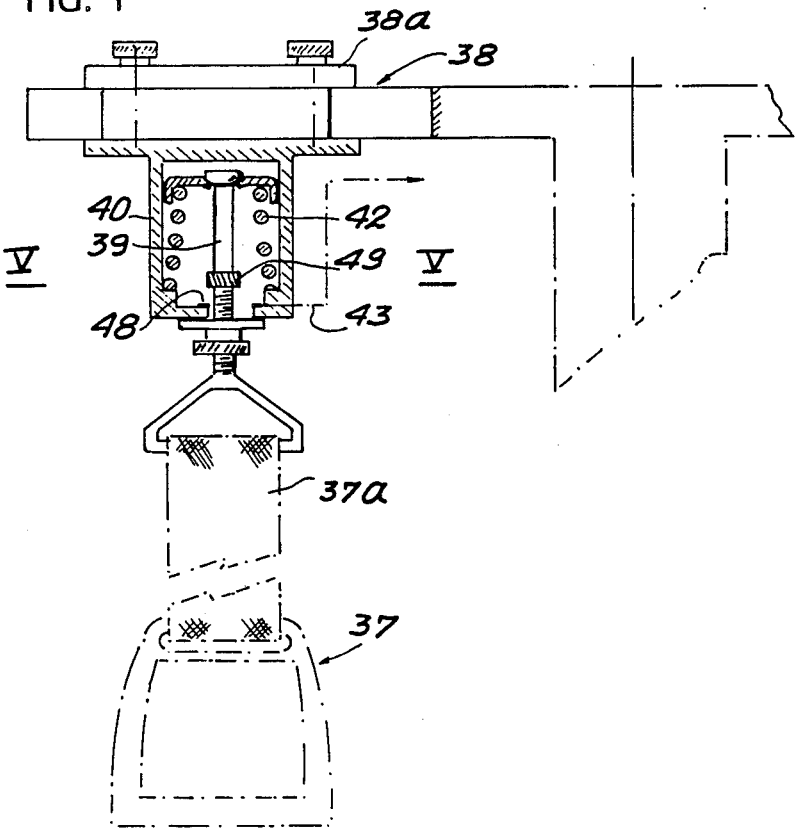
FIG. 4 is a fragmentary view in elevation showing another control device which can be employed with the apparatus shown in FIG. 2.
Figure 6:
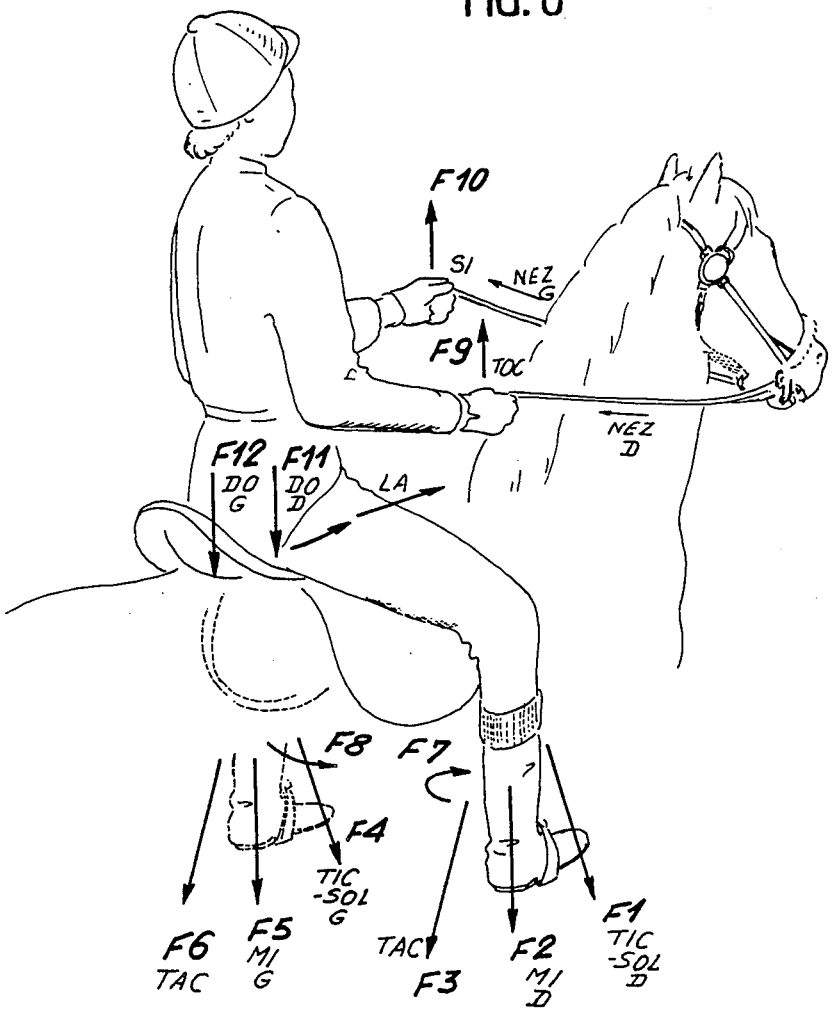
FIG. 6 is a perspective view showing a horse and its rider, the main possibilities of control action or aids applied by the rider being shown in this figure.

However, FIGS. 5 and 6 illustrate another control device which makes it possible to come even closer to practical conditions of horse-riding. This device is so designed that the aids or control actions provided for the feet are really carried out by the feet under the usual conditions, in other words on stirrups 37 within which each foot is engaged respectively. To this end, said device is provided with a horizontal bar 38 which can be fixed by means of clamps 38*a* or the like on the edge of a table or on a support representing a horse. The stirrup-irons 37 are suspended respectively from each end of said bar and the stirrup leather 37*a* is attached to a vertical rod 39 forming part of a control device having multiple contacts and associated with the corresponding stirrup-iron.

Said rod is placed within a casing 40 which is fixed beneath the corresponding end of the bar 38 and contains a spring 42 against which the top end of the rod 39 is applied. An adjustment system makes it possible to adjust the initial compression of the spring 42. This adjustment is controlled by a regulating knob connected to the display panel 5*a* by means of a circuit 43 in order to indicate the pressure exerted by the spring, which accordingly makes it possible to check this pressure.

The lower end of the vertical rod 39 passes through the bottom wall 44 of the casing 40 via an opening 45 of this latter. This opening has an elongated shape in the longitudinal direction in order to permit any forward and rearward displacements of the lower end of the rod 39. However, said opening is also provided with a recess 46 in order to permit a possible inward displacement of said rod. On the opposite side of the opening, provision is made on the contrary for a projecting portion or boss 47 which is adapted to carry a contact 48. An annular collar 49 carried by the rod 39 is intended to operate said contact 48 at the time of a purely vertical weight-applying action on the stirrup 37.

On the other hand, if the stirrup is actuated in either a forward or backward direction, the rod 39 can in that case produce action on either of the two contacts 50 and 51 located in oppositely-facing relation. Finally, another contact 52 is provided on the inner side in order to be operated by the rod 39 in the event of inward action on the stirrup 37.

In consequence, any one of these four contacts can be actuated by the rod 39 according to the nature of the control action applied on the corresponding stirrup. It is readily apparent in this case that these contacts replace the push-buttons provided in the previous embodiments for controlling the signal lamps which materialize the corresponding aids. To this end, the two control devices carried by the horizontal bar 38 are connected to the display panel 5*a* by means of a connecting cable. In combination with the foregoing, provision can be made for a manual control device constituted by two handles provided with contacts which can be actuated either by one hand or the other instead of the actions provided by the push-buttons of the casing 34 of FIG. 3.

Thus, in the embodiment illustrated in FIGS. 2 to 5, the apparatus in accordance with the invention enables the user to acquire practical training in the art of applying different types of aids to the horse in order to change its pace and/or direction in accordance with the principles of the so-called "balance method". The principal types of aids contemplated by this method are indicated by the different arrows F1, F2, F3, . . . F12 shown in FIG. 6. The user of the apparatus can thus become well-accustomed to the application of this method and can immediately judge the result obtained in each case in regard to any change of pace and/or direction of the horse.

In consequence, the apparatus under consideration enables novices in horse-riding to save many hours of training which are usually necessary in order to achieve the delicate sense of touch and "feel" of true horsemanship. However, this apparatus can also be profitably used by riders who are not beginners or who may even be experienced but need to acquire greater proficiency as well as the necessary reflexes for subsequently putting into practice the different types of aids contemplated by the "balance method" of horse-riding.

Figure 7:
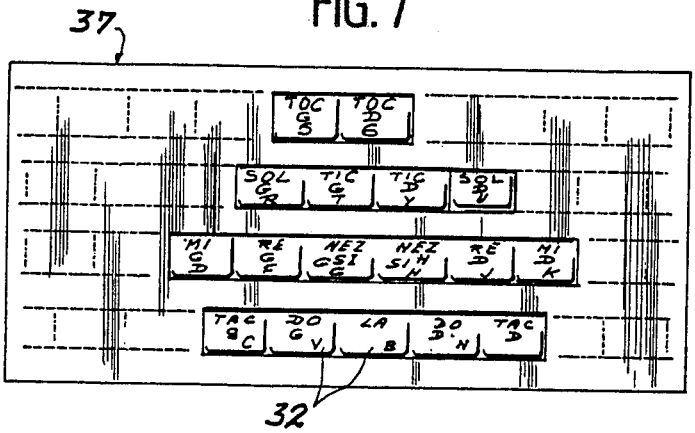
FIG. 7 illustrates a mask which is intended to be placed on the usual control keyboard of a computer when a keyboard of this type is employed.

It will be clearly apparent that this apparatus is not limited to the few embodiments and forms of construction which have been described in the foregoing and which have been given solely by way of example. It is worthy of note in this connection that the apparatus under consideration could also be constructed from either a portable or non-portable individual computer by placing a special mask of the type shown in FIG. 7 on the usual control keyboard of the computer (for example a keyboard of the AZERT type). The central portion of said mask is provided with transparent windows 32 which allow only a predetermined number of keys of the corresponding keyboard to appear, namely the keys which control the desired fictitious aids to be applied by a rider. However, these windows are each adapted to carry a coded indication of the exact nature of the aid to which a key control action corresponds. These different coded indications are those given in FIG. 6. It will readily be understood that, in such a case, the computer must be provided with logic systems specially designed for this particular application and capable of producing the desired representations on its display screen.

However, the apparatus in accordance with the invention can also be designed so as to constitute an electronic game for the purpose of entertainment while enabling the player to become familiar with the different paces of horses as well as the various control actions which can be exerted on a horse.

What is claimed is:

1. An apparatus for simulating the different paces of a horse and the aids to be applied for the purpose of controlling the horse, wherein said apparatus includes a display panel provided with:

on the one hand four representative display lamps which are intended to light-up so as to represent the precise time-duration of the instant of ground contact of the different hooves of a horse and are supplied by four separate circuits in dependence on one or a number of control devices which are capable of ensuring different lighting-up recurrence rates and sequences so as to reproduce different types of paces of a horse (walk, trot, canter, gallop, etc.);

on the other hand a signal lamp which is intended to light-up so as to represent predetermined aids for controlling a horse, said signal lamp being connected into a circuit which includes an operating key at the user's disposal and the arrangement of which is such that closing of said circuit has the effect both of turning-on the signal lamp and blocking the circuits of the representative display lamps in their state of operation at that instant.

2. An apparatus according to claim 1, wherein a second representative display is provided next to each lamp representing the time of ground contact of one of the horse's hooves, lighting-up of said second lamp being intended to represent the exact time of uplift of the same hoof, that is to say the time interval which elapses between leaving the ground and landing, the second set of representative display lamps thus provided being supplied by circuits controlled in dependence on the same control devices as the lamps representing the hoof-landing or ground contact periods in order to reproduce different types of paces of a horse in combination with said ground contact lamps.

3. An apparatus according to claim 2, wherein the display panel provides a representation of the silhouette of a horse and its rider and outlines representing the four hooves of the horse, provision being made in the location defined by each hoof-outline for a pair of lamps having the function in one case of displaying the instant of ground contact of a hoof and in the other case of displaying the instant of uplift of the corresponding hoof, provision being made instead of a single signal lamp for a series of signal lamps which have the intended function in each case of representing a predetermined aid applied by a rider and which are placed on or against the horse-silhouette in positions corresponding to the particular nature of these aids, each signal lamp being connected into a circuit provided with a control key at the user's disposal and so arranged that closing of said circuit at a predetermined moment has the effect both of turning-on said lamp and blocking the circuits of the representative display lamps in the state of said circuits at that moment.

4. An apparatus according to claim 3, wherein a signal lamp for indicating an aid applied by the rider is placed against each pair of lamps representing the times of ground contact and uplift of the different hooves of a horse, two other signal lamps indicating an applied aid being located on each side of the horse-silhouette between the two first signal lamps provided on the corresponding side in the transverse plane of the center of gravity of the horse.

5. An apparatus according to claim 4, wherein further signal lamps for illustrating a control action of the rider's hands and the effect produced by the hands on the horse's mouth and posture are provided at a location corresponding to each hand of the rider and on each side of the outline of the horse's mouth, two other signal lamps of a similar type being provided at the locations of the flanks of the horse-silhouette in order to illustrate pressures applied by the rider against the horse's flanks.

6. An apparatus according to claim 5, wherein the control contacts for at least a certain number of predetermined aid-indicating signal lamps are placed on the top face of a control unit casing which is intended to be placed on the ground in order to enable the operator to actuate said contacts with either one foot or the other whilst the contacts for controlling the other signal lamps for different aids are provided on a separate control unit casing in order to be actuated by hand.

7. An apparatus according to claim 5, wherein said apparatus includes a control device provided with two suspended stirrups which are capable of receiving both of the operator's feet and which are associated with different contacts for controlling the operation of certain predetermined signal lamps having the function of indicating predetermined aids applied by a rider, the arrangement being such that, depending on the effort and/or the displacement applied to each of said stirrups, the operator is capable of producing action on any one of the contacts associated with said stirrups in order to obtain lighting-up of the signal lamp which indicates the corresponding aid applied by a rider.

8. An apparatus according to claim 3, wherein provision is made either on the display panel itself or on an ancillary unit or another control device for a change-over switch providing the three following control positions:

a first position enabling an operator who produces action on the control contact of a signal lamp having the function of indicating a predetermined aid to obtain at that moment both lighting-up of said signal lamp and blocking of the signal lamps representing the ground contacts and uplifts of the different hooves in their positions at that moment;

a second position enabling the operator to carry out a number of different actions on the signal lamps for the indication of different predetermined aids in order to apply the teachings of the method of horse-riding known as the "balance method", the arrangement of the circuits being such that the actions aforesaid produce changes in operation in the lamps for representing ground contacts and uplifts of the horse's hooves, said changes in operation being such as to correspond to the desired changes in pace and posture of the horse;

a third position which makes it possible to obtain blocking of the representative display lamps for ground contacts and uplifts of the hooves only after the desired change of pace has taken place in order to obtain a representation of the corresponding transition.

9. An apparatus according to claim 1, wherein lighting-up of the four lamps or pairs of lamps representing the times of ground contact and/or uplift of the different hooves of a horse is controlled by logic systems having different programs which are capable of reproducing various types of paces and the arrangement is such that said programs are capable of being influenced and of sending different operating instructions to the corresponding lamps as a function of the action produced by the operator on the control contacts of the signal lamps for indicating the different possible aids which can be applied by a rider.

10. An apparatus according to claim 9 wherein, in order to make use of the usual keyboard of a portable or non-portable individual computer, provision is made for a mask having transparent windows showing only those keys which are assigned to control of the different fictitious aids applied by a rider, said windows being provided with coded indications for identifying each of the aids produced by the corresponding keys.

* * * * *